US009919518B2

(12) United States Patent
Yamaguchi et al.

(10) Patent No.: US 9,919,518 B2
(45) Date of Patent: Mar. 20, 2018

(54) PRINTING ELEMENT SUBSTRATE, LIQUID EJECTION HEAD, AND PRINTING APPARATUS

(71) Applicant: CANON KABUSHIKI KAISHA, Tokyo (JP)

(72) Inventors: Takaaki Yamaguchi, Yokohama (JP); Yosuke Miura, Kawasaki (JP); Chiaki Muraoka, Kawaguchi (JP); Yasushi Nakano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/395,532

(22) Filed: Dec. 30, 2016

(65) Prior Publication Data

US 2017/0190173 A1 Jul. 6, 2017

(30) Foreign Application Priority Data

Jan. 6, 2016 (JP) ..... 2016-000965

(51) Int. Cl.
*B41J 2/045* (2006.01)
*B41J 2/14* (2006.01)

(52) U.S. Cl.
CPC ..... *B41J 2/04541* (2013.01); *B41J 2/04548* (2013.01); *B41J 2/04581* (2013.01); *B41J 2/14201* (2013.01); *B41J 2002/14491* (2013.01)

(58) Field of Classification Search
CPC ..... B41J 2/04541; B41J 2/04548; B41J 2/04581; B41J 2/14201; B41J 2002/14491; B41J 2/0455
See application file for complete search history.

(56) References Cited

U.S. PATENT DOCUMENTS 6,890,048 B2 * 5/2005 Hirayama ..... B41J 2/04523 257/204
9,463,618 B2 * 10/2016 Fujii ..... B41J 2/04541

FOREIGN PATENT DOCUMENTS

JP 2010155452 A 7/2010
JP 2015189049 A 11/2015

* cited by examiner

*Primary Examiner* — Thinh H Nguyen
(74) *Attorney, Agent, or Firm* — Canon USA, Inc. I.P. Division

(57) ABSTRACT

A printing element substrate includes a plurality of printing elements, a first transistor forming an electrical pathway common to the plurality of printing elements, and a plurality of second transistors for driving the plurality of printing elements independently of each other. An electrical pathway is formed between a first power node and a second power node in the order of the first transistor, one of the plurality of printing elements, and one of the plurality of second transistors. The electrical pathway connecting each of the plurality of printing elements and the first transistor includes a plurality of electrical paths.

16 Claims, 5 Drawing Sheets

PRINTING ELEMENT SUBSTRATE, LIQUID EJECTION HEAD, AND PRINTING APPARATUS

BACKGROUND OF THE INVENTION

Field of the Invention

The present disclosure relates to a printing element substrate, a liquid ejection head, and a printing apparatus.

Description of the Related Art

Some liquid ejection heads, for example, an ink-jet print head that ejects ink to print an image, use an electrothermal conversion element (a heater) or a piezoelectric element as a printing element for generating ejection energy. Such an ink-jet print head applies driving voltage to a printing element and ejects ink from ejection ports using the ejection energy generated from the printing element. Since the amount of ink ejected from the ejection ports changes according to the driving voltage applied to the printing element, it is important to stabilize the driving voltage to stabilize liquid ejection characteristics. Japanese Patent Laid-Open No. 2010-155452 discloses a configuration in which the gate voltage of a PMOS transistor connected to one end of each heater and the gate voltage of an NMOS transistor connected to the other end of the heater are individually controlled by individual voltage conversion circuits. The voltage conversion circuits, the PMOS transistor, the NMOS transistor, and the heater are provided on a print head substrate. PMOS is an abbreviation of a p-channel metal-oxide semiconductor, and NMOS is an abbreviation of an n-channel metal-oxide semiconductor.

However, the print-head substrate disclosed in Japanese Patent Laid-Open No. 2010-155452 has two transistors for each of the plurality of heaters. This increases the number of heaters to increase the area of a substrate on which the transistors are disposed, thus making it difficult to achieve size reduction of the substrate.

In contrast, Japanese Patent Laid-Open No. 2015-189049 discloses a print-head substrate having a first transistor that forms an electrical pathway common to a plurality of heaters and a plurality of second transistors that independently drive the plurality of heaters. In other words, this print-head substrate has the first transistor shared by a plurality of heaters, while having a plurality of transistors for one heater. This stabilizes the liquid ejection characteristics, while allowing the substrate to be smaller than a configuration in which the number of first transistors and the number of second transistors are the same as the number of heaters.

However, the liquid ejection characteristics of the print-head substrate disclosed in Japanese Patent Laid-Open No. 2015-189049 can sometimes become unstable. Specifically, if a printing element, such as a heater, is broken, a wiring line connected from the first transistor to the printing element can corrode into breakage. This can make the liquid ejection characteristics unstable because not only driving voltage applied to the broken printing element but also driving voltage applied to another printing element connected to the same first transistor as that connected to the broken printing element can drop or stop.

SUMMARY OF THE INVENTION

The present disclosure provides a compact liquid ejection head substrate with a simple configuration and a liquid ejection head capable of maintaining stable liquid ejection performance.

In an aspect of the present disclosure, a printing element substrate includes a plurality of printing elements, a first transistor forming an electrical pathway common to the plurality of printing elements, and a plurality of second transistors for driving the plurality of printing elements independently of each other. An electrical pathway is formed between a first power node and a second power node in the order of the first transistor, one of the plurality of printing elements, and one of the plurality of second transistors. The electrical pathway connecting each of the plurality of printing elements and the first transistor includes a plurality of electrical paths.

Further features of the present invention will become apparent from the following description of exemplary embodiments with reference to the attached drawings.

DESCRIPTION OF THE EMBODIMENTS

Figure 4A:
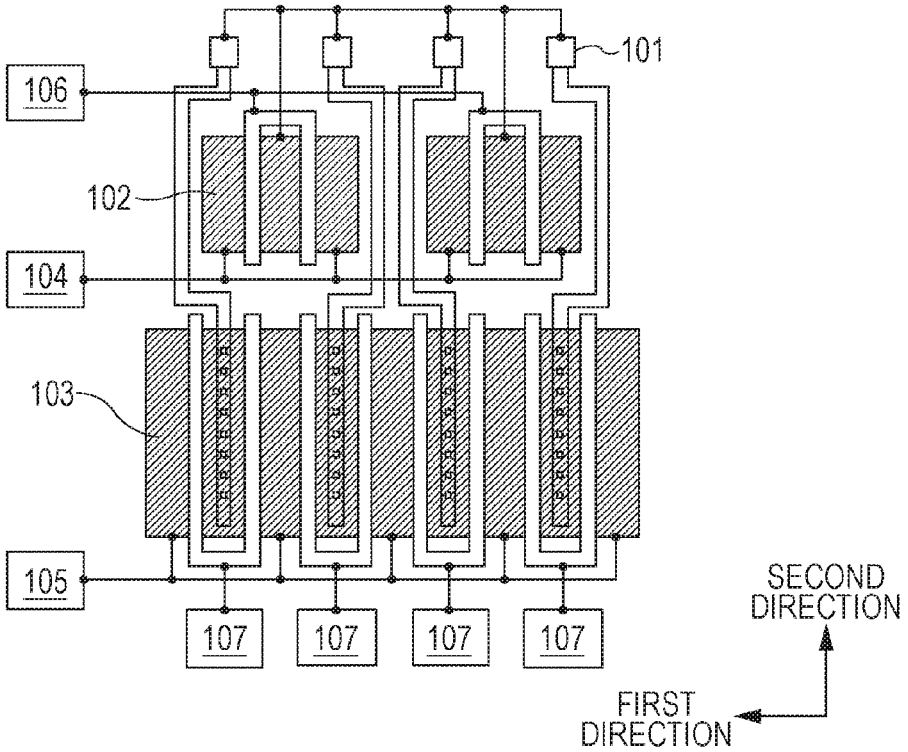
FIG. 4A is a schematic diagram of the planar configuration of a printing element substrate according to according to a comparative example of the present disclosure.
Figure 4B:
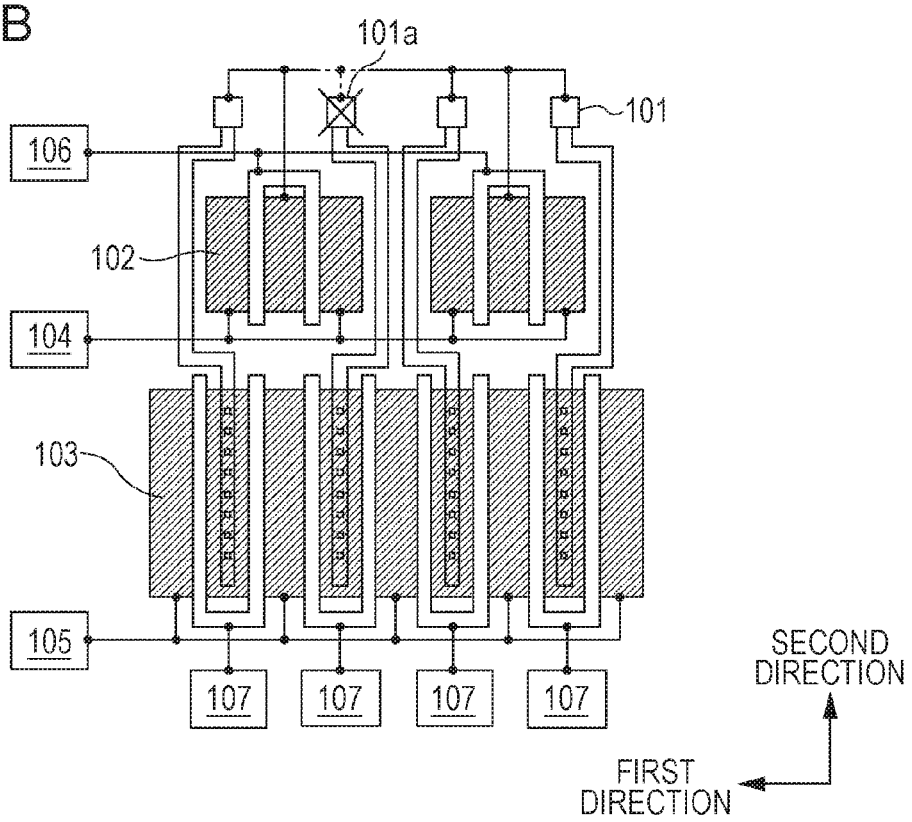
FIG. 4B is a schematic diagram of the planar configuration of a printing element substrate according to according to a comparative example of the present disclosure.

Before embodiments of the present disclosure are described, the details of an example of problems to be solved by the present disclosure will be described using a comparative example of the present disclosure. FIGS. 4A and 4B are schematic diagrams of the planar configuration of a printing element substrate according to a comparative example of the present disclosure.

The printing element substrate includes a plurality of printing elements 101. The printing elements 101 are elements that convert electrical energy to ejection energy for ejecting liquid, for example, heaters. The plurality of printing elements 101 are disposed side by side in a first direction. The printing element substrate further includes a first transistor 102 and a plurality of second transistors 103. Transistors are elements in which current is controlled by an electrical signal supplied to the gate. One transistor includes one or a plurality of MOS transistors. If one transistor includes a plurality of MOS transistors, the plurality of MOS transistors are controlled by a common electrical signal. Specifically, the sources of the plurality of MOS transistors are connected to each other, the drains are connected to each other, and the gates are connected to each other.

In the example illustrated in FIG. 4A, one first transistor 102 and a plurality of second transistors 103 are electrically connected to the plurality of printing elements 101. In other words, the plurality of printing elements 101 share one first transistor 102. This decreases the number of transistors disposed on the printing element substrate while providing a plurality of transistors for each of the plurality of printing elements 101. Thus, the printing element substrate can be made compact.

The first transistor 102 is disposed between the plurality of printing elements 101 and the plurality of second transistors 103. Thus, the first transistor 102 and the plurality of second transistors 103 are disposed in this order from the side closer to the plurality of printing elements 101 in a second direction crossing the first direction in a plan view of the printing element substrate. Sharing the first transistor 102 among the plurality of printing elements 101 reduces the area of the first transistor 102 as compared with a case in which the same number of first transistors 102 as the number of printing elements 101 are provided. This can decrease the distance between the printing elements 101 and the second transistors 103 to decrease the length of wiring lines connecting the printing elements 101 and the second transistors 103 and can consequently enhance the liquid ejection performance.

An example in which a printing element of such a printing element substrate is broken will be described with reference to FIG. 4B. A break of a printing element 101*a* in FIG. 4B can induce corrosion of the wiring line from the broken portion. The first transistor 102 includes a plurality of transistors whose drain, source, and gate are used in common. If the corrosion advances to a portion of the printing element 101*a* connected to the second transistor 103, only the corroded printing element 101*a* would fail in ejection. However, if the corrosion advances from the broken portion to a portion connected to the first transistor 102, wiring lines connecting the plurality of transistors of the first transistor 102 would be broken. This can cause failure of part of the transistors of the first transistor 102. This decreases the driving voltage applied to the plurality of printing elements 101, making the liquid ejection performance unstable.

Embodiments of the present disclosure will be described hereinbelow with reference to the accompanying drawings. Duplicated descriptions will be sometimes omitted by giving the same reference signs to components having the same function in the specification and drawings. Although embodiments of the present disclosure will be described using examples, the embodiments are not intended to limit the present disclosure. For example, a configuration in which part of the configuration of one of the following embodiments is added to another embodiment or replaced with part of another embodiment is also an embodiment within the technical scope of the embodiments of the present disclosure.

The following are embodiments of a printing element substrate including printing elements that eject liquid, such as ink. This printing element substrate can be used in a liquid ejection head equipped with a liquid supply unit for supplying liquid, such as ink, on a printing element substrate. An example of the liquid ejection head is a print head that prints an image with ejected liquid. This liquid ejection head can be used in a printing apparatus including a driving unit that drive a liquid ejection head. Examples of the printing apparatus include a printer and a copier. Alternatively, the liquid ejection head can be used in a production apparatus for producing three-dimensional structures, DNA chips, organic transistors, or organic color filters.

First Embodiment

Figure 1A:
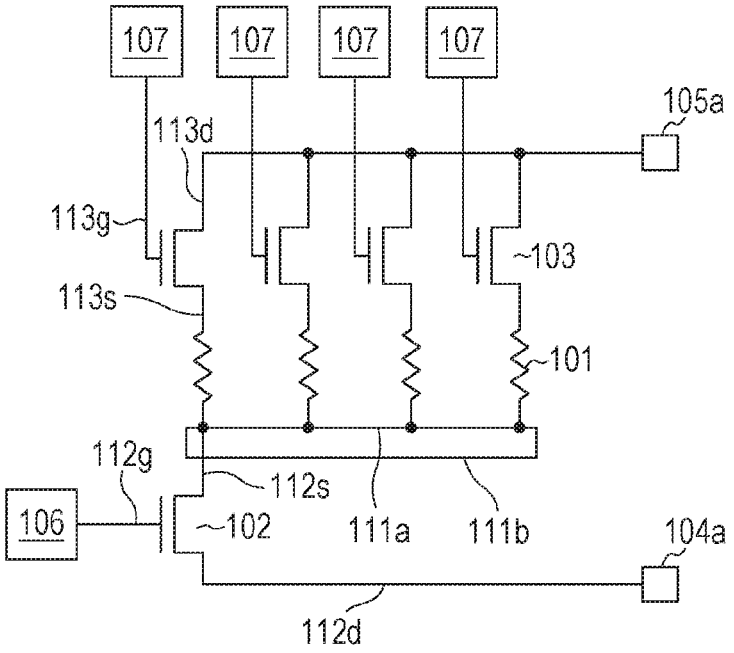
FIG. 1A is a schematic diagram of an equivalent circuit of a printing element substrate according to a first embodiment of the present disclosure.
Figure 1B:
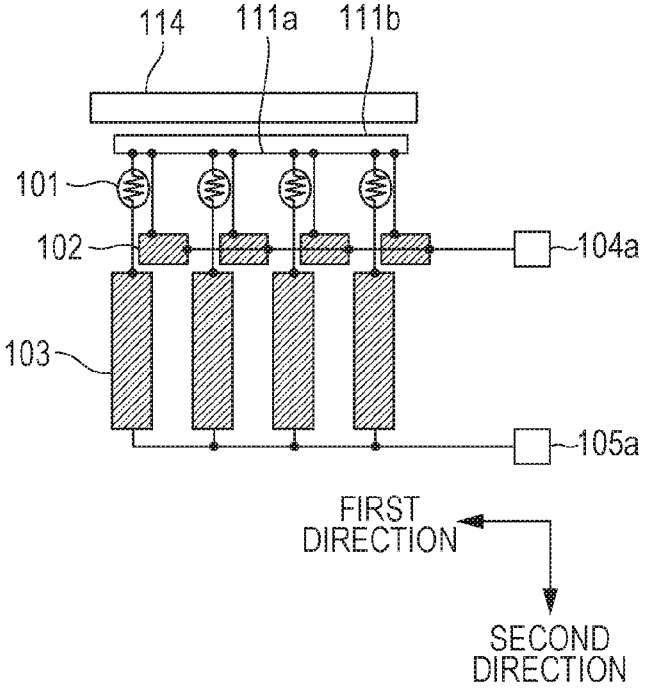
FIG. 1B is a schematic diagram illustrating the planar configuration of the printing element substrate according to the first embodiment of the present disclosure.

FIGS. 1A and 1B are diagrams illustrating the configuration of a printing element substrate according to a first embodiment of the present disclosure. FIG. 1A is a schematic diagram of an equivalent circuit of the printing element substrate according to the first embodiment of the present disclosure. FIG. 1B is a schematic diagram illustrating the planar configuration of the printing element substrate according to the first embodiment of the present disclosure.

The printing element substrate illustrated in FIG. 1A includes a plurality of printing elements 101, a first transistor 102 shared by the plurality of printing elements 101, a plurality of second transistors 103, a first power node 104*a*, and a second power node 105*a*. The printing element substrate further includes a driving unit 106 and control units 107.

The first transistor 102, the printing elements 101, and the second transistors 103 are electrically connected in this order between the first power node 104*a* and the second power node 105*a*. The first transistor 102 is connected to four printing elements 101. The first transistor 102 is hereinafter referred to as a common transistor 102. The second transistors 103 are provided for the four printing elements 101 in one-to-one correspondence. The second transistors 103 are hereinafter referred to as individual transistors 103.

The first power node 104*a* and the second power node 105*a* are supplied with different voltages. For example, the first power node 104*a* is supplied with ground voltage (for example, 0 V), and the second power node 105*a* is supplied with power supply voltage (for example, 32 V).

The common transistor 102 forms a common electrical pathway for the plurality of printing elements 101 between the first power node 104*a* and the plurality of printing elements 101. Each of the plurality of individual transistors 103 forms an electrical pathway between corresponding one of the plurality of printing elements 101 and the second power node 105*a*. The plurality of printing elements 101 and the plurality of individual transistors 103 form a plurality of electrical pathways between the common transistor 102 and the second power node 105*a*.

The common transistor 102 is a PMOS transistor, which is a constant-voltage generating element forming a source follower, and includes a gate 112*g*, a source 112*s*, and a drain 112*d*. The common transistor 102 can be constituted of two or more transistors whose drain, source, and gate are used in common. These transistors are disposed in different active regions arranged in the same direction as that of columns of the printing elements 101. The drain 112*d* of the common transistor 102 is electrically connected to the first power node 104*a*. The source 112*s* of the common transistor 102 is electrically connected to one end of each of the plurality of printing elements 101. The common transistor 102 and the printing elements 101 are connected by a main line 111*a*, which is a first wiring line with which the source 112*s* of the common transistor 102 and one end of each of the plurality of printing elements 101 are connected in the shortest distance. Furthermore, a loop line 111*b* is provided, which is a second wiring line connecting both ends of the main line 111*a* to form a loop-like electrical pathway together with the main line 111*a*. This configuration makes the electrical pathway connecting the printing elements 101 to the common transistor 102 double-tracked. In other words, the electrical pathway connecting the printing elements 101 to the common transistor 102 includes a plurality of electrical paths. The gate 112*g* of the common transistor 102 is electrically connected to the driving unit 106.

Each of the plurality of individual transistors 103 is an NMOS transistor forming a source follower, which is a driver used as a switch, and includes a gate 113*g*, a source 113*s*, and a drain 113*d*. The source 113*s* of each of the plurality of individual transistors 103 is electrically connected to corresponding other end of the plurality of printing elements 101. The drain 113*d* of each of the plurality of individual transistors 103 is electrically connected to the second power node 105*a*. The gate 113*g* of each of the individual transistors 103 is electrically connected to corresponding one of the control units 107.

The gate 112*g* of the common transistor 102 is supplied with an electrical signal from the driving unit 106. The common transistor 102 forms a source follower. This configuration allows the voltage of the source 112*s* of the common transistor 102 to be controlled on the basis of the electrical signal supplied to the gate 112*g* of the common transistor 102.

The gate 113*g* of each of the individual transistors 103 is supplied with a control signal from the control unit 107. Controlling current flowing through the individual transistors 103 using the control signals supplied from the control unit 107 allows current flowing through the printing elements 101 to be controlled. Each of the individual transistors 103 forms a source follower. This configuration allows the voltage of the source 113*s* of each of the individual transistors 103 to be controlled on the basis of an electrical signal supplied to the gate 113*g* of each of the individual transistors 103.

The plurality of individual transistors 103 are controlled independently of each other. In this embodiment, the control units 107 is provided for each of the individual transistors 103. This configuration allows the timing of applying electric current to each of the plurality of printing elements 101 to be individually controlled by controlling the individual transistors 103 with the control units 107. For example, the four individual transistors 103 shown in FIGS. 1A and 1B can be controlled such that one of the individual transistors 103 is turned on and the other three are turned off.

As illustrated in FIG. 1B, the plurality of printing elements 101 are disposed next to each other in the first direction on the printing element substrate. The first direction is, for example, the direction of the long sides of the printing element substrate. The second direction is a direction crossing the first direction, for example, at right angles. Although the plurality of printing elements 101 in FIG. 1B are disposed side by side on a straight line, the positions of the plurality of printing elements 101 in the second direction can differ from one another.

The common transistor 102 and the plurality of individual transistors 103 are disposed on one side of the substrate with reference to the printing element array in which the plurality of printing elements 101 are arrayed. This disposition makes it easy to provide an ink supply path 114 (also referred to as "ink supply port") in the vicinity of the printing elements 101. The ink supply path 114 is a liquid supply path for supplying liquid, such as ink, to the printing elements 101 and is communicable to an external liquid supply source. Specifically, the common transistor 102 and the individual transistors 103 are disposed in this order from the side near to the printing element array in the second direction. In other words, the common transistor 102 is disposed between the plurality of printing elements 101 and the plurality of individual transistors 103. Connecting wiring lines connecting the printing elements 101 and the common transistor 102 are led out from the side of the common transistor 102 close to the printing elements 101. The plurality of individual transistors 103 are disposed next to each other in the first direction. Connecting wiring lines connecting the printing elements 101 and the individual transistors 103 are led out from the side of the printing elements 101 near to the individual transistors 103. The connecting wiring lines connecting the printing elements 101 and the individual transistors 103 traverse in the second direction around the region of the common transistor 102.

In this embodiment, each of the common transistor 102 and the individual transistors 103 is provided in a rectangular region. Since the common transistor 102 is constituted of a plurality of MOS transistors whose drain, gate, and source are used in common, the common transistor 102 is disposed in a plurality of regions. Each region is provided with a MOS transistor that constitutes the common transistor 102. Each of the plurality of regions is a rectangle whose long sides extend in the first direction, as shown in FIG. 1B. The plurality of rectangular regions are at the same position in the second direction and are disposed side by side on a straight line extending in the first direction, and therefore form a rectangular region whose long sides extend in the first direction. Since one common transistor 102 is provided for the plurality of printing elements 101, the long side of the region in which the common transistor 102 is provided is longer than the interval between the printing elements 101. The region in which each individual transistor 103 is provided is a rectangle whose long sides extend in the second direction. One individual transistor 103 is provided for each printing element 101. For this reason, the length of the sides of the region of the individual transistor 102 in the first direction is substantially equal to the interval between the printing elements 101.

Specifically, in this embodiment, one common transistor 102 is provided for the four individual transistors 103. Hence, in the first direction, the region in which the common transistor 102 is disposed is about four times as long as the region in which the individual transistors 103 are disposed. In the second direction, the region in which the common transistor 102 is disposed is shorter than the region in which the individual transistors 103 is disposed.

In this embodiment, the electrical pathway connecting the printing elements 101 and the common transistor 102 is double-tracked. Specifically, the printing elements 101 are connected to the main line 111*a* that forms the shortest route to the source 111*s* of the common transistor 102 and to the loop line 111*b* that forms a different route from that of the main line 111*a*. In other words, the double-tracked electrical pathway is a loop-like electrical pathway formed of the main line 111*a* and the loop line 111*b*. This configuration allows the printing elements 101 and the common transistor 102 to be kept connected by the loop line 111*b* even if the main line 111*a* is broken, and hence maintains the stability of the liquid ejection performance.

Furthermore, in this embodiment, the loop line 111*b* forms a loop from the outside of the endmost printing elements 101 of the plurality of printing elements 101 in the first direction in which the plurality of printing elements 101 are disposed. The loop line 111*b* can be provided in a wiring layer different from that of the main line 111*a*. However, this needs a hole for connecting the wiring layers. Providing the hole around the printing elements 101 can affect the liquid ejection performance and makes it difficult to densely dispose the printing elements 101. For this reason, the loop line 111*b* and the main line 111*a* may be disposed in the same wiring layer. The main line 111*a* and the loop line 111*b* can be disposed in the same layer as that of electrodes for supplying electric power to the printing elements 101. The main line 111*a* and the loop line 111*b* may be disposed between the printing elements 101 and the ink supply path 114. One of the loop line 111*b* and the main line 111*a* may have higher impedance than the other. For example, the loop line 111*b* may have higher impedance than the main line 111*a*. This is because, the difference in impedance can retard corrosion of a high-impedance wiring line even if the wiring line corrodes. As described above, disposing the loop line 111*b* outside the printing elements 101 at both ends of the plurality of printing elements 101 that share the common transistor 102 makes it easy to increase the wiring length, thereby increasing the impedance.

Second Embodiment

Figure 2A:
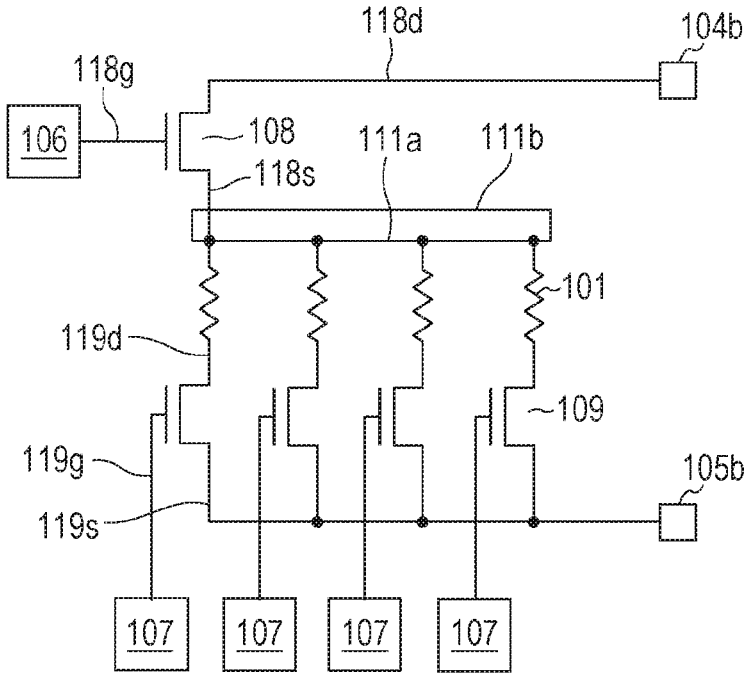
FIG. 2A is a schematic diagram of an equivalent circuit of a printing element substrate according to a second embodiment of the present disclosure.
Figure 2B:
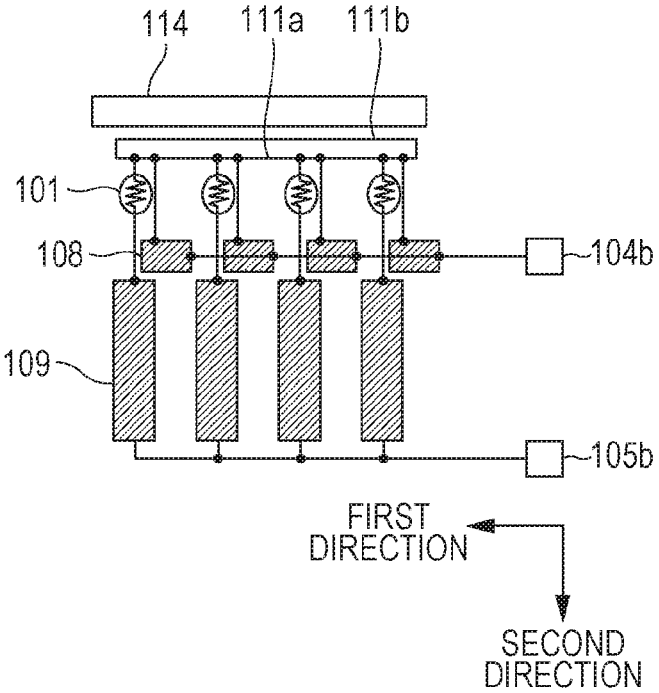
FIG. 2B is a schematic diagram illustrating the planar configuration of the printing element substrate according to the second embodiment of the present disclosure.

Next, a second embodiment of the present disclosure will be described. FIGS. 2A and 2B are schematic diagrams respectively illustrating the planar configuration and an equivalent circuit of a printing element substrate according to the second embodiment of the present disclosure. In the diagrams, the same components as in the first embodiment are given the same reference signs, and duplicated descriptions will be omitted.

The equivalent circuit of the printing element substrate shown in FIG. 2A includes a first transistor 108 instead of the first transistor 102 of the equivalent circuit of the printing element substrate shown in FIG. 1A and includes second transistors 109 instead of the second transistors 103.

The first transistor 108, one of the plurality of printing elements 101, and one of the plurality of second transistors 109 are electrically connected in this order between a first power node 104*b* and a second power node 105*b*. The first transistor 108 is connected to the four printing elements 101 to form an electrical pathway common to the four printing elements 101. Four second transistors 109 are provided for the four printing elements 101 and are connected thereto in a one-to-one correspondence. The first transistor 108 is hereinafter referred to as a common transistor 108, and the second transistors 109 are referred to as individual transistors 109.

The first power node 104*b* and the second power node 105*b* are supplied with different voltages. For example, the first power node 104*b* is supplied with power supply voltage (for example, 32 V), and the second power node 105*b* is supplied with ground voltage (for example, 0 V).

The common transistor 108 forms a common electrical pathway for the plurality of printing elements 101 between the first power node 104*b* and the plurality of printing elements 101. Each of the plurality of individual transistors 109 forms an electrical pathway between corresponding one of the plurality of printing elements 101 and the second power node 105*b*. The plurality of printing elements 101 and the plurality of individual transistors 109 form a plurality of electrical pathways between the common transistor 108 and the second power node 105*b*.

The common transistor 108 is an NMOS transistor, which is a constant-voltage generating element forming a source follower, and includes a gate 118*g*, a source 118*s*, and a drain 118*d*. The common transistor 108 can be constituted of a plurality of transistors whose drain, source, and gate are used in common. The drain 118*d* of the common transistor 108 is electrically connected to the first power node 104*b*. The source 118*s* of the common transistor 108 is electrically connected to one end of each of the plurality of printing elements 101. The source 118*s* of the common transistor 108 and the printing elements 101 are connected by a main line 111*a*, which is a wiring line connected in the shortest distance, and a loop line 111*b* forming a different electrical pathway from that of the main line 111*a*. The loop line 111*b* forms a loop-like electrical pathway together with the main line 111*a*. This configuration makes the electrical pathway connecting from the printing elements 101 to the common transistor 108 double-tracked. The gate 118*g* of the common transistor 108 is electrically connected to the driving unit 106.

Each of the individual transistors 109 is an NMOS transistor and includes a gate 119*g*, a source 119*s*, and a drain 119*d*. The source 119*s* of each of the individual transistors 109 is electrically connected to the second power node 105*b*. Thus, each individual transistor 109 constitutes a source grounded driver in which the source 119*s* is grounded. The drain 119*d* of each individual transistor 109 is electrically connected to corresponding one of the plurality of printing elements 101. The gate 119*g* of each individual transistor 109 is electrically connected to corresponding one of the control units 107. This configuration allows current flowing through the individual transistors 109 to be controlled on the basis of control signals supplied from the control units 107, thus forming switches for controlling current flowing through the printing elements 101. In this embodiment, the control units 107 are provided one for each of the plurality of individual transistors 109. Hence the plurality of individual transistors 109 are controlled independently of each other. This configuration allows the control units 107 to control the individual transistors 109 to prevent current from flowing through the printing elements 101 at the same time. For example, the four individual transistors 109 shown in FIGS. 2A and 2B can be controlled such that one of the individual transistors 109 is turned on and the other three are turned off.

The gate 118*g* of the common transistor 108 is supplied with an electrical signal from the driving unit 106. Since the common transistor 108 forms a source follower, the voltage of the source 118*s* of the common transistor 108 can be controlled on the basis of the electrical signal supplied to the gate 118*g* of the common transistor 108.

As illustrated in FIG. 2B, the plurality of printing elements 101 are disposed next to each other in the first direction on the printing element substrate. The first direction is, for example, the direction of the long sides of the printing element substrate. The second direction is a direction crossing the first direction, for example, at right angles. Although the plurality of printing elements 101 in FIG. 2B are disposed side by side on a straight line, the positions of the plurality of printing elements 101 in the second direction can differ from one another.

The common transistor 108 and the plurality of individual transistors 109 are disposed on one side of the substrate with reference to the printing element array in which the plurality of printing elements 101 are arrayed. This disposition makes it easy to provide an ink supply path 114 in the vicinity of the printing elements 101.

Specifically, the common transistor 108 and the individual transistors 109 are disposed in this order from the side near to the printing element array in the second direction. In other words, the common transistor 108 is disposed between the plurality of printing elements 101 and the plurality of individual transistors 109. Connecting wiring lines connecting the printing elements 101 and the common transistor 108 are led out from the side of the common transistor 108 close to the printing elements 101. The plurality of individual transistors 109 are disposed next to each other in the first direction. Connecting wiring lines connecting the printing elements 101 and the individual transistors 109 are led out from the side of the printing elements 101 near to the individual transistors 109. The connecting wiring lines connecting the printing elements 101 and the individual transistors 109 traverse in the second direction around the region of the common transistor 108.

A region on the printing element substrate in which the common transistor 108 is provided is similar to the region of the common transistor 102 in the first embodiment. A region on the printing element substrate in which the individual transistors 109 are disposed is similar to the region of the individual transistors 103 in the first embodiment. For this reason, a detailed description will be omitted in this embodiment.

Since the physical disposition of the double-tracked electrical pathway connecting the printing elements 101 and the first transistor 108 is also similar to the disposition of the electrical pathway connecting the printing elements 101 and the first transistor 102 in the first embodiment, a detailed description will be omitted here.

Configuration of Print Head and Printing Apparatus

FIGS. 3A to 3D are diagrams illustrating the configuration of a liquid ejection head, a printing apparatus, and a control circuit for the printing apparatus in which the printing element substrate according to the first or second embodiment of the present disclosure can be used.

Figure 3A:
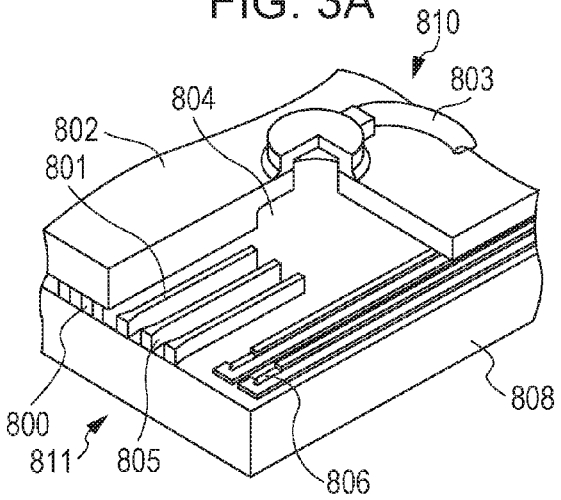
FIG. 3A is a diagrams of a liquid ejection head in which the printing element substrate according to the first or second embodiment of the present disclosure can be used.

FIG. 3A illustrates a liquid-ejection head unit 811, which is a main component of a liquid ejection head 810. The liquid ejection head 810 includes a head body 808, which is the printing element substrate described in the first or second embodiment. The liquid ejection head 810 further includes a channel member 801 and a top plate 802. The channel member 801 and the top plate 802 are disposed on the head body 808. The channel member 801 includes a plurality of ejection ports 800 and channels 805 communicating with the ejection ports 800. The top plate 802 is provided with an ink supply port 803 for supplying ink and a common liquid chamber 804 in which the ink supplied through the ink supply port 803 can be stored. The common liquid chamber 804 communicates with the channels 805. A plurality of heat generating units 80 are provided on the head body 808. The printing elements 101 described in the first and second embodiments correspond to the heat generating units 806. With this configuration, the ink supplied through the ink supply port 803 is reserved in the internal common liquid chamber 804 and is supplied to the individual channels 805. By driving the heat generating units 806 in that state, the ink is ejected from the ejection ports 800.

Figure 3B:
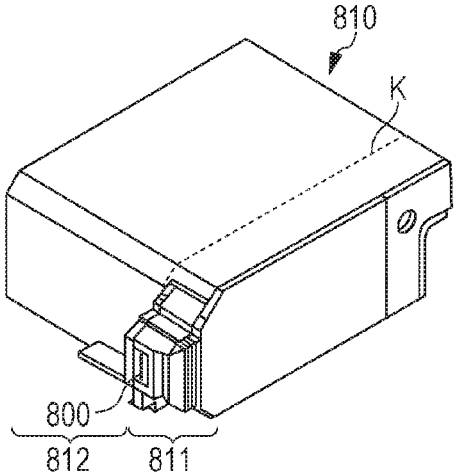
FIG. 3B is a diagram illustrating the overall configuration of the liquid ejection head.

FIG. 3B is a diagram illustrating the overall configuration of the liquid ejection head 810. The liquid ejection head 810 includes the liquid-ejection head unit 811 described above and an ink container 812 that reserves ink to be supplied to the liquid-ejection head unit 811. The ink container 812 is detachably mounted on the liquid-ejection head unit 811. A boundary K indicates the boundary between the ink container 812 and the liquid-ejection head unit 811. The liquid ejection head 810 has an electrical contact (not shown) for receiving an electrical signal from a carriage 920 (see FIG. 3C) when mounted on a printing apparatus that prints using the liquid ejection head 810. The heat generating units 806 generates heat on the basis of the electrical signal. The ink container 812 includes a fibrous or porous ink absorber therein for holding ink, with which the ink is reserved.

Figure 3C:
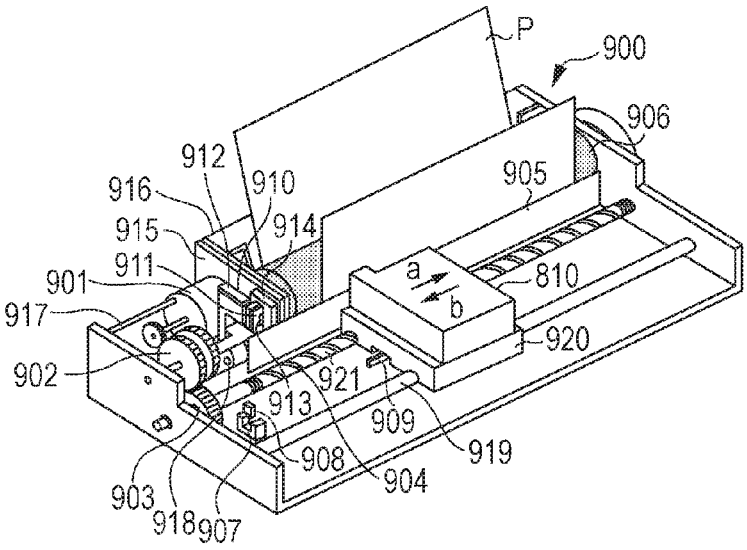
FIG. 3C is an external perspective view of a printing apparatus equipped with the liquid ejection head according to the first or second embodiment of the present disclosure.

FIG. 3C is an external perspective view of an ink-jet printing apparatus 900 equipped with the liquid ejection head 810 described using FIG. 3B, illustrating the configuration thereof. The printing apparatus 900 includes the liquid ejection head 810 and controls a signal to be supplied to the liquid ejection head 810.

The liquid ejection head 810 is mounted on the carriage 920. The carriage 920 engages with a spiral groove 921 of a lead screw 904 that rotates in cooperation with the rotation of a driving motor 901 via driving-force transmission gears 902 and 903. This configuration allows the liquid ejection head 810 to reciprocate in the directions of arrows a and b together with the carriage 920 along a guide 919 by the driving force of the driving motor 901. Printing paper P is conveyed onto a platen 906 by a printing-medium feeding unit (not shown). A bail plate 905 pushes the printing paper P against the platen 906 along the moving direction of the carriage 920.

The printing apparatus 900 further includes photocouplers 907 and 908. The photocouplers 907 and 908 serve as a home-position detecting unit and detect a home position by detecting a lever 909 provided at the carriage 920. The photocouplers 907 and 908 detect that the carriage 920 is at a home position on the basis of whether the lever 909 is in a region in which the photocouplers 907 and 908 are disposed. When the photocouplers 907 and 908 detect that the carriage 920 is at a home position, the printing apparatus 900 can switch, for example, the rotating direction of the driving motor 901.

A supporting member 910 supports a cap member 911 that covers the whole of the ejection ports 800 of the liquid ejection head 810. A suction unit 912 sucks inside the cap member 911 to recover the liquid ejection head 810 via an in-cap opening 913. A moving member 915 allows a cleaning blade 914 to move in the front-to-back direction. The cleaning blade 914 and the moving member 915 are supported by a main-body supporting plate 916. A lever 917 is provided to start suction for recovery and moves with the movement of a cam 918 engaging with the carriage 920. A printing control unit (not shown) is provided at the apparatus main body. The printing control unit generates signals to be supplied to the heat generating units 806 of the liquid ejection head 810 to control driving of the driving motor 901 and other components.

The printing apparatus 900 prints on the printing paper P in such a manner that the liquid ejection head 810 ejects liquid while reciprocating across the full width of the printing paper P. The liquid ejection head 810 is compact and capable of high-speed printing because it uses the printing element substrate according to the first or second embodiment.

Figure 3D:
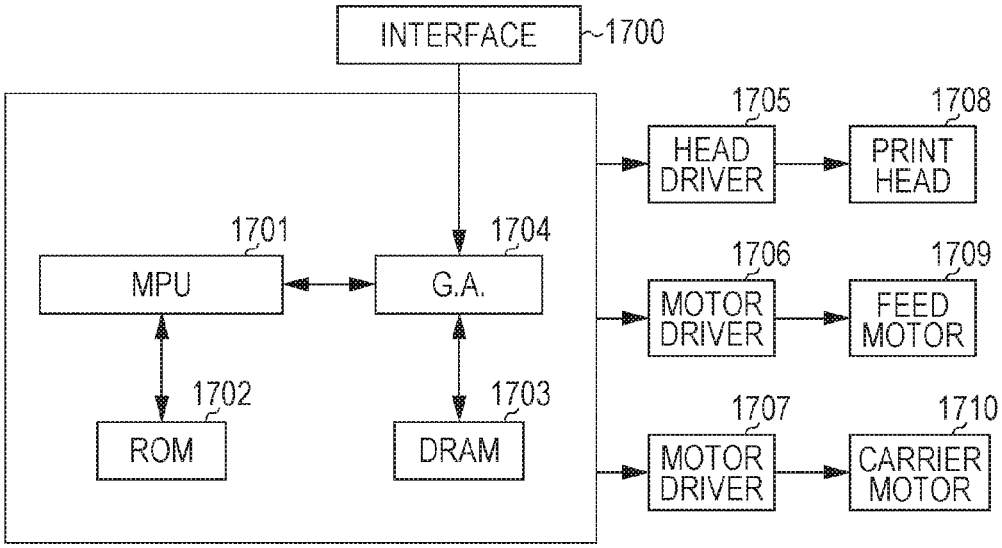
FIG. 3D is a block diagram illustrating the configuration of a control circuit for the printing apparatus.

FIG. 3D is a block diagram illustrating the configuration of a control circuit for the printing apparatus 900. The control circuit includes an interface 1700, a micro-processing unit (MPU) 1701, and a program read-only memory (ROM) 1702. The control circuit further includes a dynamic random access memory (RAM) 1703 and a gate array 1704.

The control circuit further includes a head driver 1705 and motor drivers 1706 and 1707. The control circuit drives a print head 1708 using the head driver 1705, drives a feed motor 1709 using the motor driver 1706, and drives a carrier motor 1710 using the motor driver 1707. The feed motor 1709 generates a driving force for feeding printing paper P. The carrier motor 1710 generates a driving force for moving the print head 1708.

The interface 1700 receives print signals. The program ROM 1702 stores control programs that the MPU 1701 executes. The dynamic RAM 1703 stores the above print signals and various pieces of data, such as print data to be supplied to the liquid ejection head 810. The gate array 1704 controls supply of print data to the print head 1708. The gate array 1704 also controls transfer of data among the interface 1700, the MPU 1701, and the RAM 1703.

With the thus-configured control circuit, when a print signal is input to the interface 1700, the print signal is converted to print data between the gate array 1704 and the MPU 1701. As the motor drivers 1706 and 1707 are driven, the print head 1708 is driven for printing according to print data sent to the head driver 1705.

While this application has been described with reference to the embodiments, it is to be understood that this application is not limited to the above embodiments. The configuration and the details of the application can be changed in various forms that those skilled in the art can understand within the scope of the application.

For example, in the above embodiments, one common transistor 102 or common transistor 108 is provided for the four printing elements 101. However, the present disclosure is not limited to the example. The number of printing elements 101 that share one common transistor 102 or 108 is not limited to the example of the embodiments. The number may be any number.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-000965 filed Jan. 6, 2016, which is hereby incorporated by reference herein in its entirety.

What is claimed is:

1. A printing element substrate comprising:

a plurality of printing elements;

a first transistor electrically connected to one end of each of the plurality of printing elements; and a plurality of second transistors for driving the plurality of printing elements independently of each other, wherein an electrical pathway is formed between a first power node and a second power node in order of the first transistor, one of the plurality of printing elements, and one of the plurality of second transistors, and wherein a plurality of electrical pathways is formed between the one end of each of the plurality of printing elements and the first transistor.

2. The printing element substrate according to claim 1, wherein the plurality of electrical pathways comprises a first wiring line connecting the one end of each of the plurality of printing elements and a second wiring line connecting both ends of the first wiring line.

3. The printing element substrate according to claim 2, wherein the second wiring line has a higher impedance than the first wiring line.

4. The printing element substrate according to claim 2, wherein the plurality of printing elements is disposed along a first direction, wherein the second wiring line passes outside endmost printing elements of the plurality of printing elements connected to the first transistor along the first direction to connect both ends of the first wiring line.

5. The printing element substrate according to claim 2, wherein the first wiring line and the second wiring line are disposed in an identical layer.

6. The printing element substrate according to claim 2, further comprising a supply port for supplying liquid to at least one of the printing elements, wherein at least a part of the second wiring line is provided between the supply port and the printing elements.

7. The printing element substrate according to claim 2, wherein the first transistor is connected to the first wiring line.

8. The printing element substrate according to claim 1, further comprising a supply port for supplying liquid to at least one of the printing elements, wherein the plurality of printing elements is disposed along a first direction, wherein the supply port, the printing elements, the first transistor, and the second transistors are disposed in this order along a second direction crossing the first direction, and wherein the plurality of electrical pathways is provided between the supply port and the printing elements.

9. The printing element substrate according to claim 1, wherein the first transistor is a constant-voltage generating element comprising a PMOS transistor whose drain is connected to the first power node and whose source is connected to the plurality of printing elements to constitute a source follower, and wherein the plurality of second transistors each comprises an NMOS transistor, used as a switch, whose drain is connected to the second power node and whose source is connected to corresponding one of the plurality of printing elements to form a source follower.

10. The printing element substrate according to claim 1, wherein the first transistor is a constant-voltage generating element comprising an NMOS transistor whose drain is connected to the first power node and whose source is connected to the plurality of printing elements to form a source follower, and wherein each of the plurality of second transistors is a source grounded driver used as a switch and comprises an NMOS transistor whose source is connected to the second power node and whose drain is connected to corresponding one of the plurality of printing elements.

11. The printing element substrate according to claim 1, wherein the first transistor comprises at least two transistors whose drain, source, and gate are used in common, the first transistors being disposed in different active regions in a same direction as a direction in which the plurality of elements is arrayed.

12. A liquid ejection head comprising the printing element substrate according to claim 1.

13. A printing apparatus comprising:

a liquid ejection head according to claim 12; and a control unit that causes the liquid ejection head to eject liquid supplied to the liquid ejection head.

14. A printing element substrate comprising:

a plurality of printing elements; and a first transistor electrically connected to one end of each of the plurality of printing elements, wherein a plurality of electrical pathways is formed between the one end of each of the plurality of printing elements and the first transistor, and wherein the plurality of electrical pathways comprises a first wiring line connecting the one end of each of the plurality of printing elements and a second wiring line connecting both ends of the first wiring line.

15. The printing element substrate according to claim 14, wherein the second wiring line has a higher impedance than the first wiring line.

16. The printing element substrate according to claim 14, further comprising a supply port for supplying liquid to at least one of the printing elements, wherein at least a part of the second wiring line is provided between the supply port and the printing elements.

* * * * *